US005984465A

United States Patent [19]

Yun

[11] Patent Number: 5,984,465

[45] Date of Patent: Nov. 16, 1999

[54] INK CARTRIDGE UNIT OF INK JET PRINTER

[75] Inventor: Seog-Jin Yun, Suwon, Rep. of Korea

[73] Assignee: SamSung Electronics Co., Ltd., Suwon, Rep. of Korea

[21] Appl. No.: 08/926,237

[22] Filed: Sep. 10, 1997

[30] Foreign Application Priority Data

Sep. 10, 1996 [KR] Rep. of Korea ..... 96-39128

[51] Int. Cl.[6] ..... B41J 2/175

[52] U.S. Cl. ..... 347/87

[58] Field of Search ..... 347/49, 84, 85, 347/86, 87

[56] References Cited

U.S. PATENT DOCUMENTS

| | | | |
|---|---|---|---|
| D. 375,523 | 11/1996 | Murray | D18/56 |
| 4,907,018 | 3/1990 | Pinkerpell et al. | 346/139 R |
| 4,972,270 | 11/1990 | Kurtin et al. | 358/296 |
| 5,136,305 | 8/1992 | Ims | 347/7 |
| 5,329,294 | 7/1994 | Ontawar et al. | 347/87 |
| 5,359,357 | 10/1994 | Takagi et al. | 347/49 |
| 5,408,256 | 4/1995 | Keen et al. | 347/87 |
| 5,629,725 | 5/1997 | Buican | 347/49 |
| 5,663,753 | 9/1997 | Story et al. | 347/86 |

FOREIGN PATENT DOCUMENTS 0 536 980 A2 4/1993 European Pat. Off. .

*Primary Examiner*—N. Le
*Assistant Examiner*—Anh T. N. Vo
*Attorney, Agent, or Firm*—Robert E. Bushnell, Esq.

[57] ABSTRACT

A refillable, unitary ink cartridge and carriage device including a refiner for refilling ink; guides cooperatively guiding the device along a rail; and a shaft insertion hole receiving a shaft on which the ink cartridge unit is reciprocally translated.

9 Claims, 5 Drawing Sheets

INK CARTRIDGE UNIT OF INK JET PRINTER

CLAIM OF PRIORITY

This application makes reference to, incorporates the same herein, and claims all benefits accruing under 35 U.S.C. §119 from an application entitled Ink Cartridge Unit of Ink Jet Printer earlier filed in the Korean Industrial Property Office on the $10^{th}$ day of Sep. 1996, and there duly assigned Ser. No. 96-96-39128 by that Office.

BACKGROUND OF THE INVENTION

1. Field of the Invention

The present invention relates to an ink jet printer and, more specifically, to an ink cartridge unit for an ink jet printer.

2. Description of the Related Art

In general, an ink jet printer sequentially conveys, page by page, a plurality of cut sheets of recording papers from a paper feed tray to a printer head by a pick up roller and a finger. The recording papers pass beneath an ink cartridge which injects ink through a nozzle at a head thereof. Periodically, the ink cartridge must be refilled with the ink.

Exemplars of current designs include U.S. Pat. No. 4,907,018 for Prinithead-carriage Alignment and Electrical Interconnect Lock-in Mechanism, issued to Pinkerpell et al., referring to FIG. 6A, the invention provides for a separate ink cartridge and carriage. U.S. Pat. No. 4,972,270 for Facsimile Recorder with Acutel, Mounted Staggered Array Ink Jet Printhead, issued to Kurtin et al., referring to FIG. 1, the device includes a print head mounted on a carriage 101.

U.S. Pat. No. 5,329,294 for User Refillable Ink Jet Cartridge and Method for Making Said Cartridge issued to Ontawar et al., referring to FIG. 3, the invention provides for an ink cartridge having a sealing opening 20 which may be raptured with a filler tube, then plugged. U.S. Pat. No. 5,408,256 for Refillable Color Ink Jet Cartridge and Method for Making Said Cartridge, issued to Keen et al., referring to FIG. 4, the device provides for an ink cartridge including a removable cap 26. The device also has refill holes 20, 22 and 24.

I have found that structures such as these presents many problems. First, because the ink cartridge and the carriage are manufactured separately, the overall cost is competitively prohibitive. Second, the assembly of a substantial number of component parts increases the likelihood of defects present in the finished product. Third, assembly of multiple components adversely militates against miniaturization of products.

SUMMARY OF THE INVENTION

It is an object of the present invention to provide an improved ink cartridge and carriage.

It is another object to provide a refillable, unitary ink cartridge and a carriage.

In order to achieve this and other objects, the present inventive ink cartridge includes: a refiller for refilling ink; a guide discouraging the ink cartridge unit from being slanted; and a shaft insertion hole receiving a shaft to perform reciprocating motion of the ink cartridge unit therealong.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Hereinafter, a preferred embodiment of the present invention will be concretely explained with reference to accompanying drawings.

Figure 1:
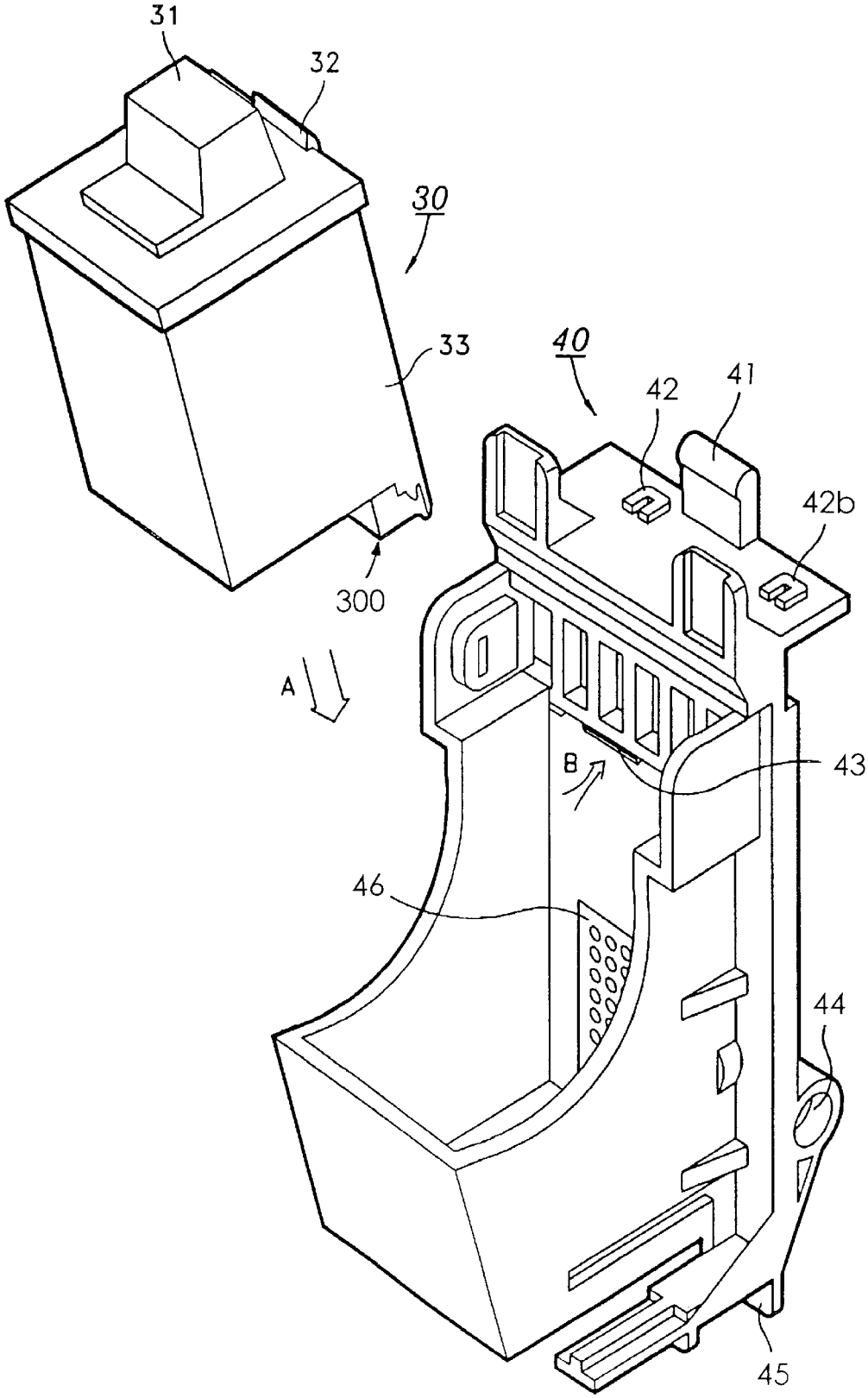
FIG. 1 is a top right front exploded perspective view of a typical ink cartridge for an ink jet printer prior to assembly with a carriage.
Figure 2:
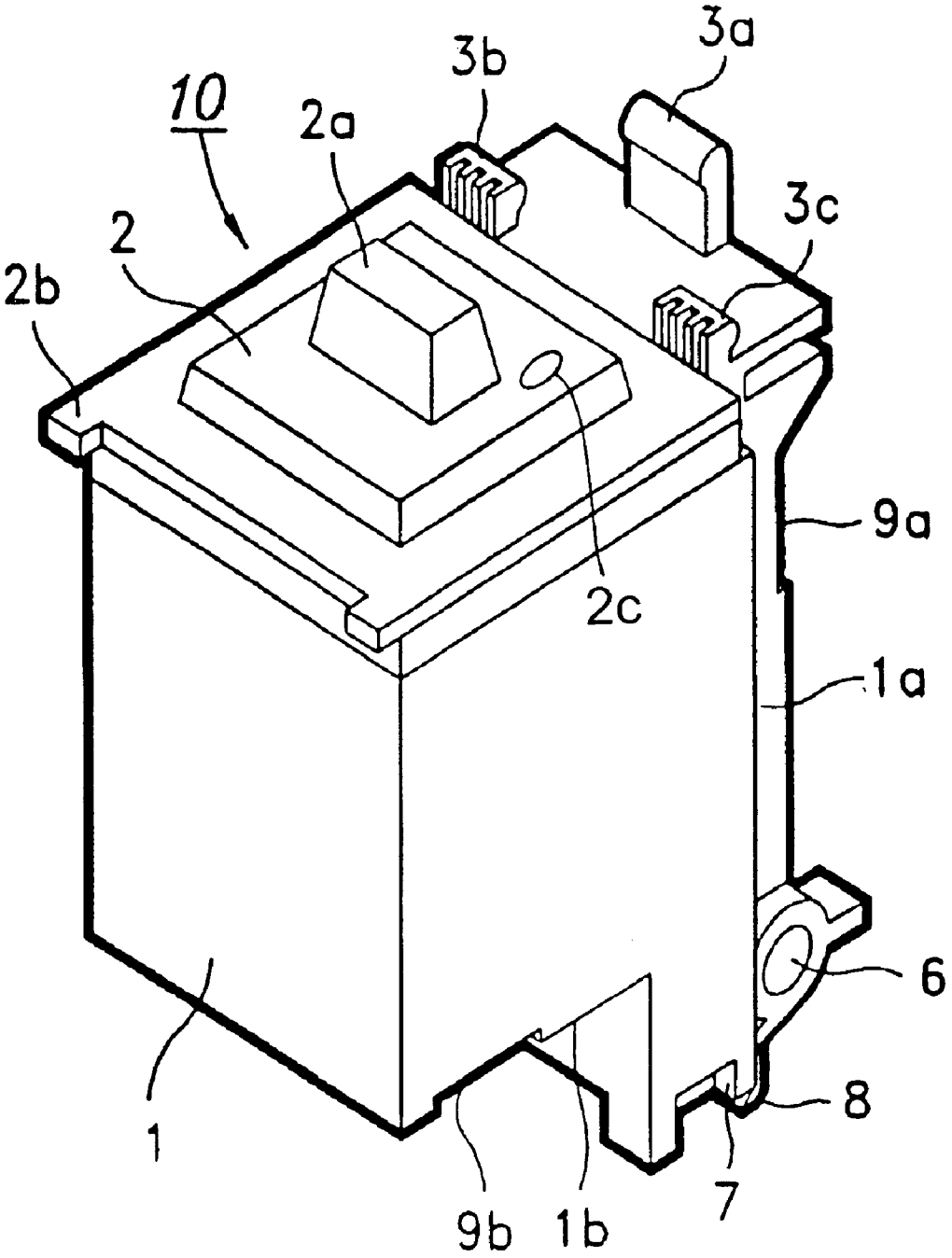
FIG. 2 is a top right front perspective view of an ink cartridge unit for an ink jet printer constructed according to the principles of the present invention.

FIG. 1 is a perspective view of an ink cartridge mounted in a typical carriage. The ink cartridge 30 includes a cap 31 and a locking boss 32. The printer head has a plurality of nozzles at a lower end 300 of the ink cartridge 30 through which ink is injected. A coupling terminal (not shown) is mounted on a rear surface of the ink cartridge 30 which is placed in contact with a coupler 36 of a carriage 40 upon mounting the ink cartridge 30 in the carriage 40. The carriage 40 is coupled with a main board of a body by a flexible printed circuit (FBC).

Guides 41, 42*a* and 42*b* extend from an upper portion of the carriage 40 which cooperate to trap a guide rail (not shown). The carriage 40 is prevented from rotating at freely about hole 44, which receives a second guide rail (not shown), by the above guides and the guide rail. Within the carriage 40, a locking bar 43 is biased outwardly by a spring to engage the locking boss 32 when the cartridge 30 is installed in the cartridge 40. A camping groove 45 is formed in the vicinity of a lower portion of the hole 44 to permit sealing of the head of the ink cartridge reaches at a home position. This design presents problems attributable to the cost incurred when the ink cartridge and the carriage are manufactured separately, that the reliance upon a greater number of components increases the likelihood of defect, and that assembly of multiple components militates against miniaturization of products.

Referring now to FIGS. 2 through 5, the ink cartridge unit 10 constructed according to the principles of the present invention simultaneously performs dual functions as a carriage and as an ink cartridge. Ink is received in the body 1 of the ink cartridge unit 10 through a refiller, configured to be opened and closed with a cap 2. A handle 2*a* extends from the cap 2 so as to facilitate opening and closing of the refiller for refilling the ink. Alternatively, ink may be refilled through an injectable opening 2*c*. Protrusions 2*b* are provided to open the refiller easily. The present ink cartridge includes guides 3*a*, 3*b* and 3*c* which cooperatively restrict rotation of the body 1 relative to a guide rail (not shown) received therebetween.

An ink cartridge constructed according to the principles of the present invention also has a camping groove 7 in a lowermost portion of the body 1 permitting sealing of the nozzles of the head when the cartridge is at a home location. A shaft insertion hole 6 is formed at a lower rear portion of the body 1.

Figure 3:
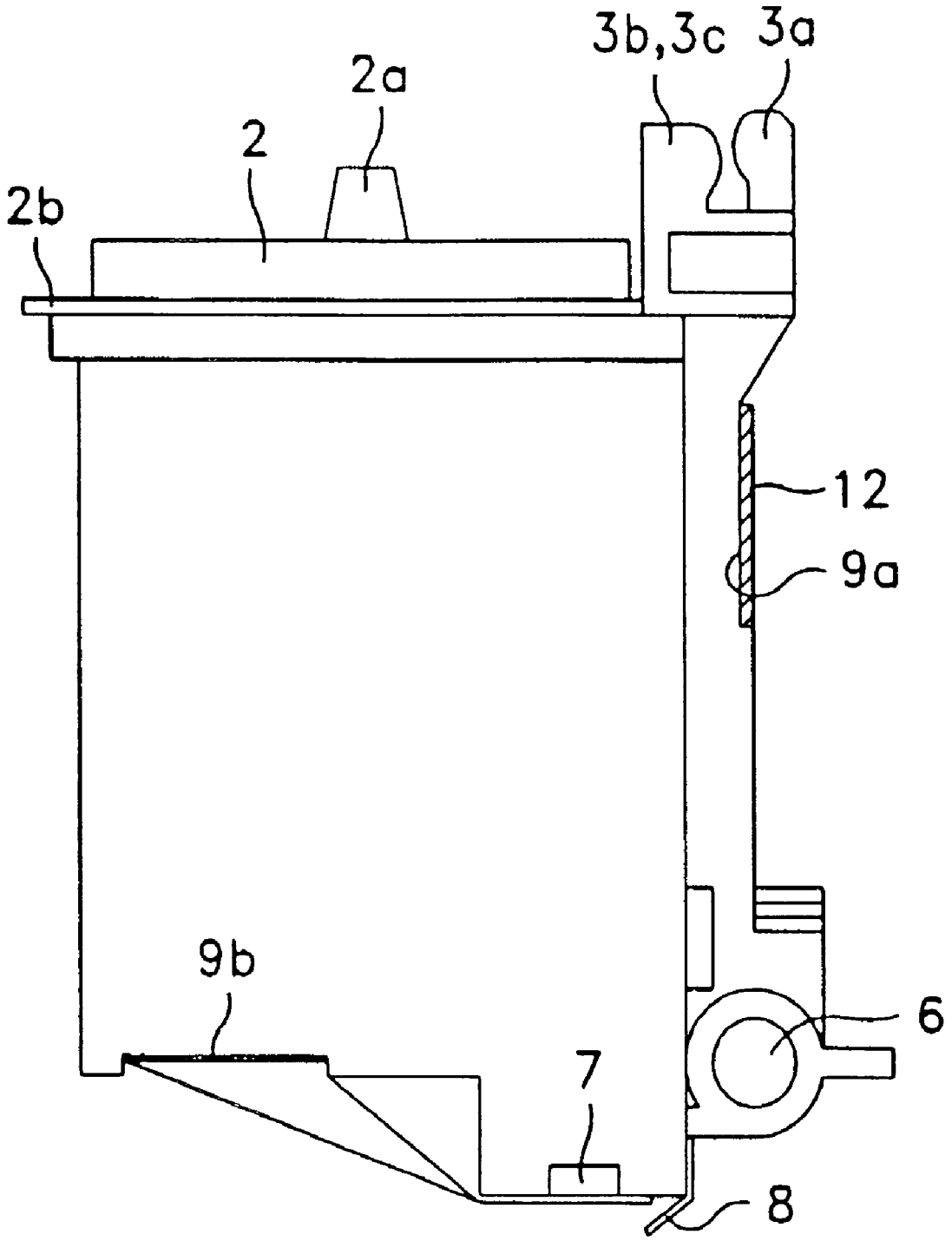
FIG. 3 is a right side elevational view of the embodiment shown in FIG. 2.
Figure 4:
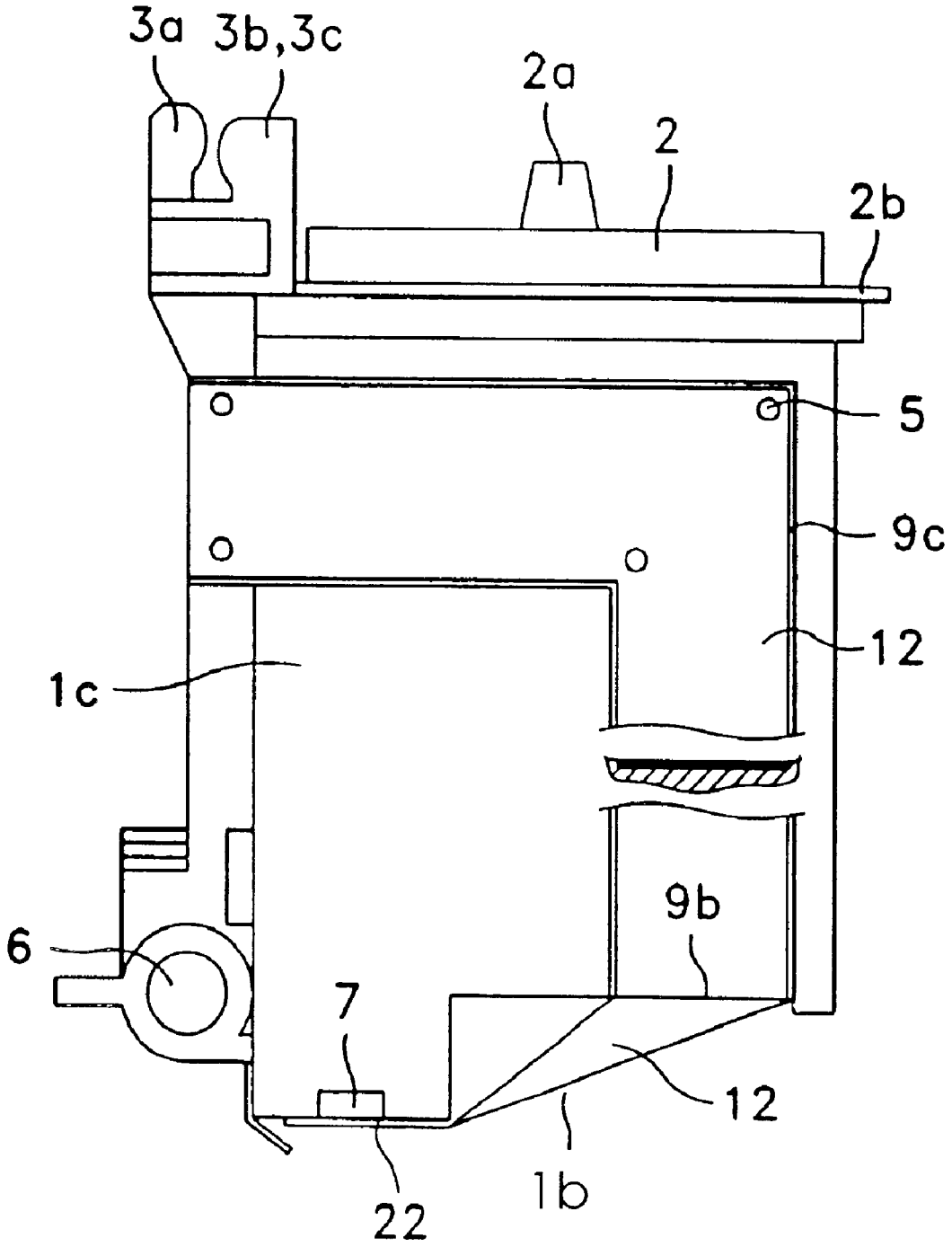
FIG. 4 is a left side elevational view of the embodiment shown in FIG. 2.
Figure 5:
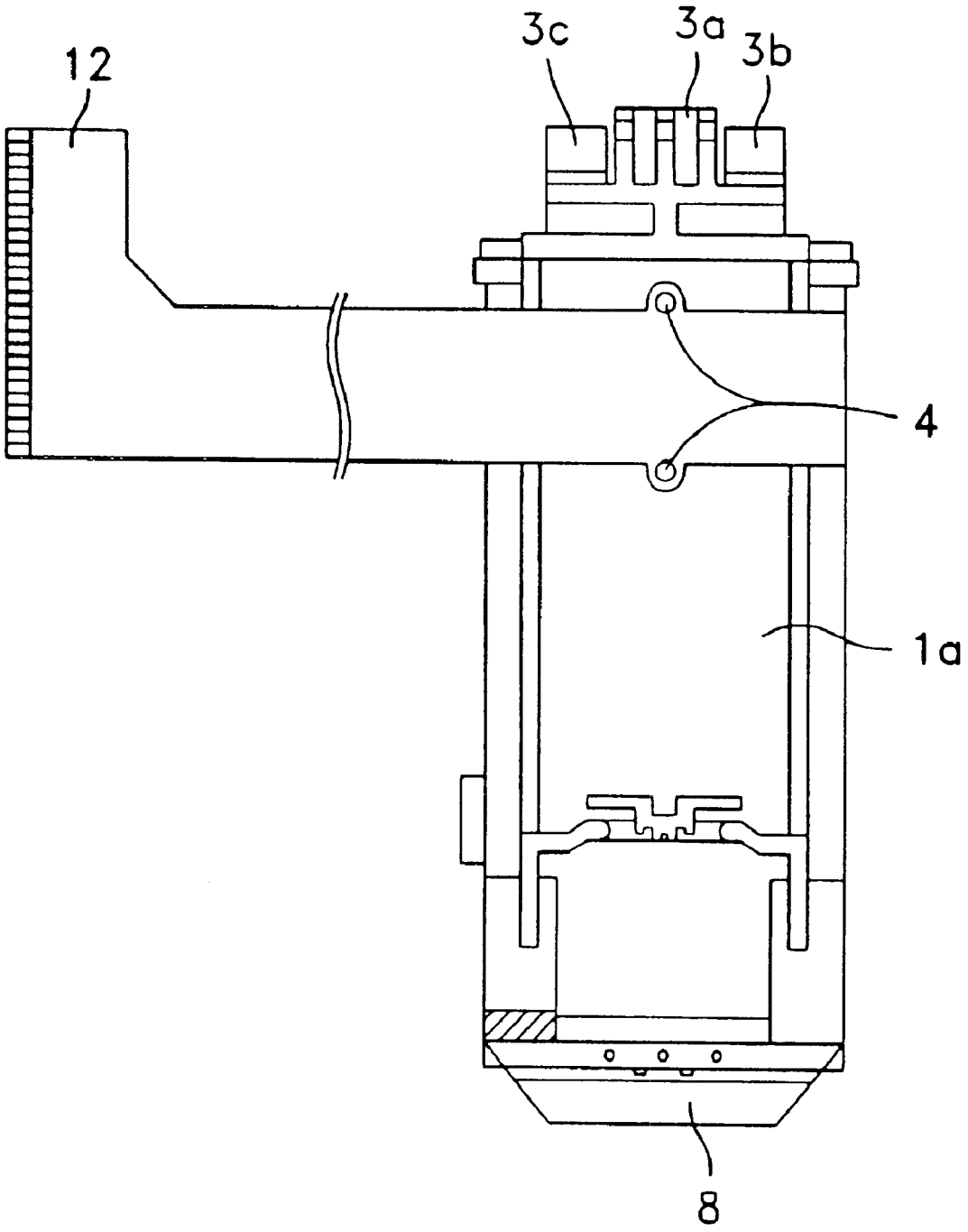
FIG. 5 is a rear elevation view of the embodiment shown in FIG. 2.

Referring to FIG. 4, a printer head 22, installed at a lowermost portion of the body 1, is connected with the FBC 12, mounted in a fixing grooves 9*a*–9*c* in the lower surface 1*b* of the ink cartridge. Referring to FIGS. 4 and 5 together, protrusions 5, formed in the vicinity of each edge of the surface 1*c*, are inserted into a groove of the FBC 12, thus fixing another groove of the FBC with protrusions 4 extending from the rear surface 1*a*. A substrate may be interposed between the body 1 and FBC 12. Referring to FIGS. 3 and 4, a deflector guide 8 is mounted on a lower portion of the camping groove 7 to deflect recording papers from interfering with the printer head.

As apparent from the foregoing, the present invention advantageous provides a unitary ink cartridge and carriage, thereby reducing manufacturing cost due to reduction of the number of components, reducing the potential for inferior goods and encouraging the miniaturization of products.

The present invention is not limited to the particular embodiment disclosed herein, but to include all improvements and modification within the scope of the appended claims.

What is claimed is:

1. A unitary ink cartridge and carriage, comprising:

a body containing ink;

a cap on an upper portion of said body allowing said body to be refilled with ink;

a guide extending from said body to accommodate the insertion of a rail received therebetween;

a shaft insertion hole on a lower portion of said body accommodating a shaft, a printer head located on the lower portion of said body, a camping groove located on said lower portion of said body; and a deflector guide mounted on a lower portion of said camping groove to deflect recording papers from interfering with the printer head, wherein said unitary ink cartridge and carriage is a single integrated monolithic unit.

2. The unitary carriage and cartridge of claim 1, said cap further comprising an injectable opening allowing for the infusion of ink into said body.

3. The unitary cartridge and carriage of claim 1, said cap further comprising a handle for removing said cap from said body to allow refill of said body with ink.

4. The unitary cartridge and carriage of claim 1, further comprising a plurality of fixing grooves located on a back portion and a side portion of said unitary cartridge and carriage, said plurality of fixing grooves including a plurality of protrusions.

5. The unitary cartridge and carriage of claim 4, further comprising a flexible printed circuit board attached to said plurality of protrusions and within said plurality of fixing grooves.

6. A unitary ink cartridge and carriage, comprising:

a body containing ink;

a cap on an upper portion of said body allowing said body to be refilled with ink;

a guide extending from said body to accommodate the insertion of a rail received therebetween;

a shaft insertion hole on a lower portion of said body accommodating a shaft, a printer head located on the lower portion of said body;

a plurality of fixing grooves located on a back portion and a side portion of said unitary cartridge and carriage, said plurality of fixing grooves including a plurality of protrusions; and a flexible printed circuit board attached to said plurality of protrusions and within said plurality of fixing grooves, wherein said unitary ink cartridge and carriage is a single integrated monolithic unit.

7. The unitary carriage and cartridge of claim 6, said cap further comprising an injectable opening allowing for the infusion of ink into said body.

8. The unitary cartridge and carriage of claim 6, said cap further comprising a handle for removing said cap from said body to allow refill of said body with ink.

9. The unitary carriage and cartridge of claim 6, further comprising:

a camping groove located on said lower portion of said body; and a deflector guide mounted on a lower portion of said camping groove to deflect recording papers from interfering with the printer head.

* * * * *